US010934496B2

(12) United States Patent
Albe et al.

(10) Patent No.: US 10,934,496 B2
(45) **Date of Patent: *Mar. 2, 2021**

(54) FISCHER-TROPSCH FEEDSTOCK DERIVED HAZE-FREE BASE OIL FRACTIONS

(71) Applicant: SHELL OIL COMPANY, Houston, TX (US)

(72) Inventors: Eglantine Armelle Christiane Colette Marie Albe, Rotterdam (NL); Godfried Johannes Aarts, Amsterdam (NL); José Luís Moniz Jardim, Amsterdam (NL); Cornelis Hyacinthus Maria Van Der Hulst, Amsterdam (NL); Eduard Philip Kieffer, Amstersdam (NL); Edward Julius Creyghton, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/471,736

(22) PCT Filed: Dec. 21, 2017

(86) PCT No.: PCT/EP2017/084089
§ 371 (c)(1),
(2) Date: Jun. 20, 2019

(87) PCT Pub. No.: WO2018/115284
PCT Pub. Date: Jun. 28, 2018

(65) Prior Publication Data

US 2020/0017780 A1 Jan. 16, 2020

(30) Foreign Application Priority Data

Dec. 23, 2016 (EP) ..... 16206807

(51) Int. Cl.
*C10G 73/12* (2006.01)
*C10G 21/16* (2006.01)
*C10G 21/28* (2006.01)

(52) U.S. Cl.
CPC ..... *C10G 73/12* (2013.01); *C10G 21/16* (2013.01); *C10G 21/28* (2013.01);
(Continued)

(58) Field of Classification Search
None
See application file for complete search history.

(56) References Cited

U.S. PATENT DOCUMENTS 1,978,010 A 10/1934 Carlisle
1,981,758 A 11/1934 Hans
(Continued)

FOREIGN PATENT DOCUMENTS

EP 0532118 A1 3/1993
EP 0666894 A1 8/1995
(Continued)

OTHER PUBLICATIONS

International Search Report and Written Opinion received for PCT Patent Application No. PCT/EP2017/084089 dated Feb. 19, 2018, 10 pages.
(Continued)

*Primary Examiner* — Tam M Nguyen

(57) ABSTRACT

The present invention relates to a method for reducing the cloud point of a Fischer-Tropsch derived fraction to below 0° C., wherein the method comprises subjecting the Fischer-Tropsch derived fraction to a cloud point reduction step comprising mixing the Fischer-Tropsch derived fraction, which comprises more than 80 wt. % of paraffins and 90 wt. % of saturates, with a solvent mixture (16), wherein the solvent mixture (16) comprises a paraffinic naphtha fraction
(Continued)

(7) and a co-solvent (15); and subjecting the solvent treatment mixture (23) to a solvent de-waxing step (17).

8 Claims, 2 Drawing Sheets

(52) U.S. Cl.
CPC ..... *C10G 2300/1022* (2013.01); *C10G 2300/201* (2013.01); *C10G 2300/302* (2013.01); *C10G 2300/304* (2013.01); *C10G 2300/308* (2013.01)

(56) References Cited

U.S. PATENT DOCUMENTS

| | | | |
|---|---|---|---|
| 2,036,966 | A | 4/1936 | Jones |
| 2,293,162 | A | 8/1942 | Montgomery et al. |
| 3,654,128 | A | 4/1972 | Woodle |
| 3,660,273 | A | 5/1972 | Cummins |
| 3,670,888 | A | 6/1972 | Boroughs et al. |
| 3,901,789 | A | 8/1975 | Michael et al. |
| 4,096,168 | A | 6/1978 | Hallgren |
| 4,343,692 | A | 8/1982 | Winquist |
| 4,574,043 | A | 3/1986 | Chester et al. |
| 4,820,400 | A | 4/1989 | Ryan et al. |
| 4,859,311 | A | 8/1989 | Miller |
| 4,892,822 | A | 1/1990 | Abramowicz et al. |
| 4,919,788 | A | 4/1990 | Chen et al. |
| 5,053,373 | A | 10/1991 | Zones |
| 5,157,191 | A | 10/1992 | Bowes et al. |
| 5,252,527 | A | 10/1993 | Zones |
| 5,354,923 | A | 10/1994 | Schoen et al. |
| 5,589,564 | A | 12/1996 | Komiya et al. |
| 7,763,745 | B2 | 7/2010 | Van Der Heide et al. |
| 2004/0152861 | A1 | 8/2004 | Nefzger et al. |
| 2010/0236990 | A1 | 9/2010 | Gleeson et al. |
| 2011/0083995 | A1 | 4/2011 | Gleeson et al. |
| 2015/0203769 | A1 | 7/2015 | Kieffer et al. |

FOREIGN PATENT DOCUMENTS

| | | | |
|---|---|---|---|
| EP | 0776959 | A2 | 6/1997 |
| EP | 0807656 | A1 | 11/1997 |
| EP | 0832171 | B1 | 1/2000 |
| EP | 1029029 | A1 | 8/2000 |
| EP | 1134248 | A1 | 9/2001 |
| EP | 1548088 | A1 | 6/2005 |
| EP | 2341122 | A1 | 7/2011 |
| GB | 509181 | A | 7/1939 |
| GB | 1154069 | A | 6/1969 |
| JP | S6416826 | A | 1/1989 |
| WO | 9718278 | A1 | 5/1997 |
| WO | 0014179 | A1 | 3/2000 |
| WO | 0029511 | A1 | 5/2000 |
| WO | 02070627 | A2 | 9/2002 |
| WO | 03070857 | A1 | 8/2003 |
| WO | 2005047439 | A2 | 5/2005 |
| WO | 2006040319 | A1 | 4/2006 |
| WO | 2006040328 | A1 | 4/2006 |
| WO | 2007009975 | A1 | 1/2007 |
| WO | 2009080681 | A2 | 7/2009 |
| WO | 2013150114 | A2 | 10/2013 |
| WO | 2014001546 | A1 | 1/2014 |
| WO | 2014189879 | A1 | 11/2014 |
| WO | 2016107912 | A1 | 7/2016 |

OTHER PUBLICATIONS

Sequeira, Lubricant Base Oil and Wax Processing, Chapter 7, 1994, pp. 153-193.

International Search Report and Written Opinion received for PCT Patent Application No. PCT/EP2016/082589, dated Feb. 6, 2017, 9 pages.

International Search Report and Written Opinion received for PCT Patent Application No. PCT/US2016/067672, dated Mar. 28, 2017, 8 pages.

International Search Report and Written Opinion received for PCT Patent Application No. PCT/US2016/067664, dated Mar. 29, 2017, 10 pages.

International Search Report and Written Opinion received for PCT Patent Application No. PCT/US2016/067666, dated Mar. 28, 2017, 8 pages.

International Search Report and Written Opinion received for PCT Patent Application No. PCT/US2016/067659, dated Mar. 21, 2017, 10 pages.

International Search Report and Written Opinion received for PCT Patent Application No. PCT/EP2017/084105, dated Feb. 19, 2018, 11 pages.

International Search Report and Written Opinion received for PCT Patent Application No. PCT/EP2016/082570, dated Feb. 13, 2017, 9 pages.

Zeng et al., "University Chemistry for Engineering Courses (second edition)", Jun. 30, 1995, pp. 267-268.

Anonymous: "Oil Viscosity Explained", Apr. 29, 2015, XP055664125, Retrieved from the Internet: URL:https://web.archive.org/web/20150429073921/https://www.kewengineering.co.uk/Auto_oils/oil_viscosity_explained.htm.

Makela et al., "Automating the NMR Analysis of Base Oils: Finding Napthene Signals", Fuel, Sep. 2013, vol. 111, pp. 543-554.

Sarpal et al., "Hydrocarbon Characterization of Hydrocracked Base Stocks by One- and Two-Dimensional NMR Spectroscopy", Fuel, Mar. 1996, vol. 75, Issue No. 4, pp. 483-490.

Scherzer et al., "Reactions and Reaction Pathways", Hydrocracking Science and Technology, 1996, Chapter 6, 25 pages.

Office Action Received for Application No. 201680075879.3 , dated Dec. 2, 2019, 9 pages(7 pages of English Translation and 2 pages of Official Copy).

FISCHER-TROPSCH FEEDSTOCK DERIVED HAZE-FREE BASE OIL FRACTIONS

CROSS REFERENCE TO EARLIER APPLICATION

The present application is the National Stage (§ 371) of International Application No. PCT/EP2017/084089, filed Dec. 21, 2017, which claims priority from EP Application 16206807.6, filed Dec. 23, 2016 incorporated herein by reference.

FIELD OF THE INVENTION

The present invention relates to a method for reducing the cloud point of a Fischer-Tropsch derived fraction.

BACKGROUND OF THE INVENTION

It is known in the art that waxy hydrocarbon feeds, including those synthesized from gaseous components such as CO and $H_2$ (such as Fischer-Tropsch waxes), are suitable for conversion/treatment into base oils by subjecting such waxy feeds to hydroisomerization/hydrocracking whereby long chain normal-paraffins and slightly branched paraffins are removed and/or rearranged/isomerized into more heavily branched iso-paraffins. Base oils produced by the conversion/treatment of waxy hydrocarbon feeds of the type synthesized from gaseous components (i.e. from Fischer-Tropsch feedstocks), are referred to hereinafter as "Fischer-Tropsch derived base oils", or simply as "FT base oils".

It is also known in the art how to prepare so-called "Fischer-Tropsch residual" (or "Fischer-Tropsch bottoms") derived base oils, referred to hereinafter as "FT residual base oils". Such FT residual base oils are often obtained from a residual (or bottoms) fraction derived from the distillation of an at least partly isomerised Fischer-Tropsch feedstock. The residual (or bottoms) fraction of said distillation step may be used directly as an FT residual base oil, or such a fraction may be further processed, such as by subjecting it to a further fractional distillation step and/or de-waxing, before being used as an FT residual base oil. WO02070627, WO2009080681 and WO2005047439 describe exemplary processes for making such FT residual base oils.

FT base oils have found use in a number of lubricant applications on account of their excellent properties, such as their beneficial viscometric properties and their purity. However at ambient temperature, FT base oils, and in particular FT residual base oils, can suffer from the undesirable presence of a waxy haze. Such waxy haze is attributed often to the presence of long carbon chain paraffins in such base oils that have not been sufficiently isomerized (or cracked). The presence of the waxy haze adversely affects the intended lubrication function of FT base oils and FT residual base oils, for example by changing their viscosity or by clogging up hardware components.

The waxy haze may be inferred or measured in a number of ways, for instance by according to the standard test method 'ASTM D4176-04'. Whilst initially ASTM D4176-04 was set up for fuels, it is also a relevant standard test method that can be adopted for base oils, by providing a numerical rating of haze appearance. Samples that pass the ASTM D4176-04 test conform to the so-called 'clear and bright' standard.

To conform to the 'clear and bright' standard, hazy FT base oils and hazy FT residual base oils need to have their cloud point reduced by a process of de-waxing. De-waxing may be carried out by treating hazy base oils with one or more solvents, or by subjecting the hazy base oils to a chemical process where insufficiently isomerized long carbon chain paraffins that contribute to the haze are catalytically isomerized/cracked to convert them into molecules that do not attribute to any haze. Solvent de-waxing has an advantage over catalytic de-waxing in that it is less complicated to carry out, for which less costly hardware maybe used. WO02070627 and WO2009080681 describe exemplary processes for solvent and catalytic de-waxing.

Solvent de-waxing is well known to those skilled in the art and involves admixture of one or more solvents and/or wax precipitating agents with a base oil or a base oil precursor fraction, and cooling the mixture to a temperature in the range of from −10° C. to −40° C., preferably in the range of from −20° C. to −35° C., to separate the wax from the oil. The oil containing the wax is then usually taken through a physical separation step, such as filtration or centrifugation, to remove the precipitated wax crystals from the base oil or the base oil precursor fraction. As a final step, the admixture can be removed from the base oil by a process such as distillation.

Examples of solvents which may be employed in the solvent de-waxing process are $C_3$-$C_6$ ketones (e.g. methyl ethyl ketone (MEK), methyl isobutyl ketone and mixtures thereof), $C_6$-$C_{10}$ aromatic hydrocarbons (e.g. toluene), mixtures of ketones and aromatics (e.g. MEK and toluene), autorefrigerative solvents such as liquefied, normally gaseous $C_2$-$C_4$ hydrocarbons such as propane, propylene, butane, butylene and mixtures thereof. Mixtures of MEK and toluene, or MEK and methyl isobutyl ketone are generally preferred. Mixture of MEK and toluene is the most preferred. Examples of these and other suitable solvent de-waxing processes are described in "Lubricant Base Oil and Wax Processing", Avilino Sequeira, Jr, Marcel Dekker Inc., New York, 1994, Chapter 7.

Without being bound to any one theory, for example where an MEK-toluene mixture is used, MEK is thought to induce wax crystal formation, and toluene is thought to reduce the viscosity of the solvent-base oil mixture, so that wax crystals may be removed by processes such as filtration or by centrifugation, which are carried out at temperatures below the cloud point of the solvent-base oil mixture. However, toluene and other aromatic hydrocarbons are substantially insoluble in Fischer-Tropsch derived fractions that are converted to FT base oils and FT residual base oils, as well as in FT base oils and FT residual base oils, probably due to such fractions' or base oils' almost exclusive alkane content. Consequently MEK-toluene solvent de-waxing of Fischer-Tropsch derived fractions, FT base oils and FT residual base oils precursor fractions is not possible. The sole use of MEK, or other known solvents, is also not suitable for the de-waxing of Fischer-Tropsch derived fractions, FT base oils and FT residual base oils.

It is therefore an object of the present invention to provide a method for reducing the cloud point of Fischer-Tropsch derived fractions, and in particular to reduce the cloud point of Fischer-Tropsch derived fractions to below 0° C. It is a further objective of the present invention to provide a method for the preparation of FT residual base oils that remain 'clear and bright' at 0° C.

SUMMARY OF THE INVENTION

Accordingly, the present invention provides a method for reducing the cloud point of a Fischer-Tropsch derived fraction to below 0° C., wherein the method comprises subjecting the Fischer-Tropsch derived fraction to a cloud point reduction step comprising: (a) adding the Fischer-Tropsch derived fraction, which fraction comprises more than 80 wt. % of paraffins and more than 90 wt. % saturates, with a solvent mixture, wherein the solvent mixture comprises a paraffinic naphtha fraction and a co-solvent to obtain a solvent treatment mixture; and (b) subjecting the solvent treatment mixture to a solvent de-waxing step.

The inventors of the present method have surprisingly discovered that the solvent mixture comprising a paraffinic naphtha fraction and a co-solvent is soluble in Fischer-Tropsch derived fractions, FT base oils and FT residual base oils, and enables their respective cloud points to be reduced below 0° C.

DETAILED DESCRIPTION OF THE INVENTION

Figure 1:
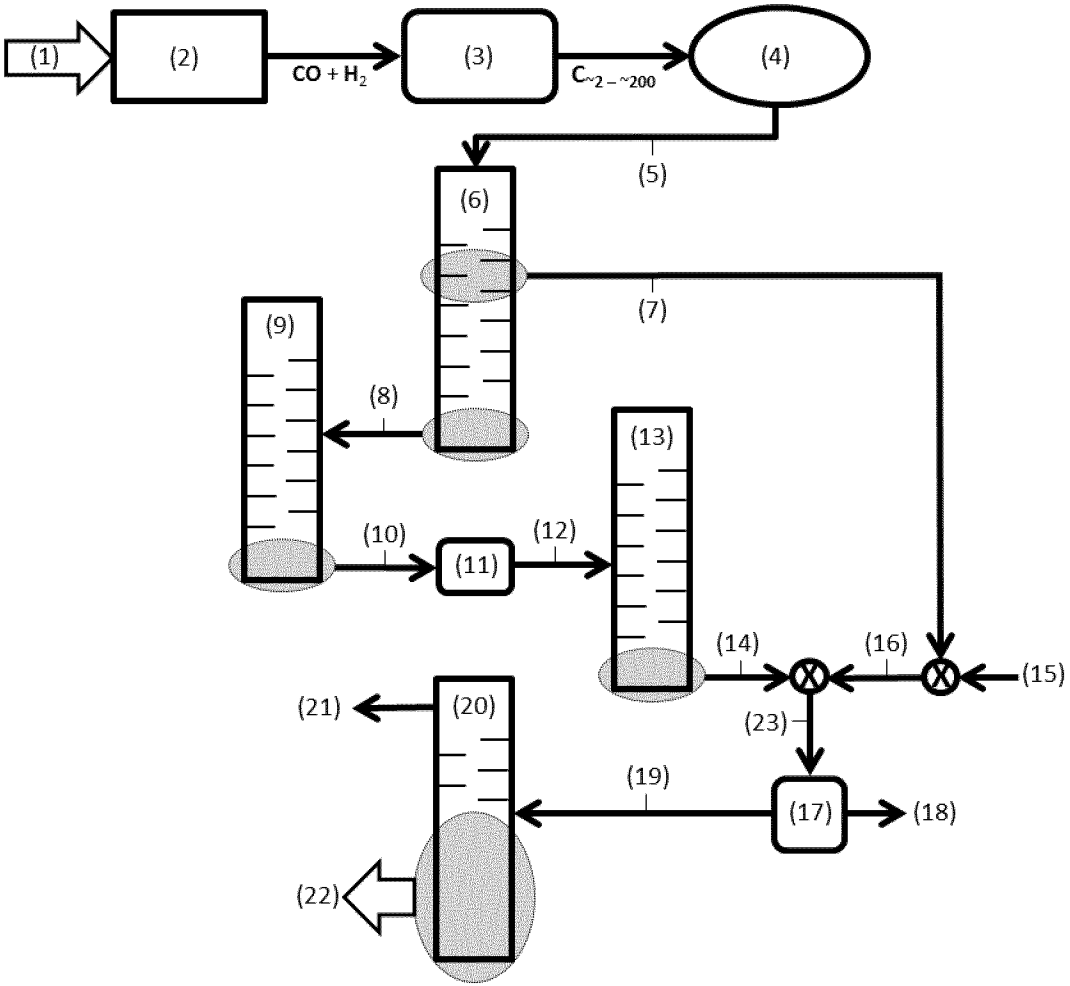
FIG. 1 shows a simplified schematic diagram of an embodiment of the method according to the invention, where the Fischer-Tropsch derived fraction is a further bottoms fraction.

The present invention concerns a method for reducing the cloud point of a Fischer-Tropsch derived fraction to below 0° C., wherein the method comprises subjecting the Fischer-Tropsch derived fraction to a cloud point reduction step comprising: (a) adding the Fischer-Tropsch derived fraction with a solvent mixture (16), wherein the solvent mixture (16) comprises a paraffinic naphtha fraction (7) and a co-solvent (15) to obtain a solvent treatment mixture (23); and (b) subjecting the solvent treatment mixture (23) to a solvent de-waxing step (17).

It is known in the art that the Fischer-Tropsch process enables the manufacture of paraffinic molecules from gaseous hydrocarbon feedstock (1) by first breaking down the hydrocarbon feedstock to carbon monoxide and hydrogen (2), then by building them up to larger paraffinic molecules (3), followed by subjecting the larger paraffinic molecules to hydroisomerization/hydrocracking (4) whereby long chain normal-paraffins and slightly branched paraffins are removed and/or rearranged/isomerized into more heavily branched iso-paraffins (5). Advantageously, the more heavily branched iso-paraffins (5), and any further fractions obtained from them, are devoid of contaminants such as sulphur.

It is also known in the art that the more heavily branched iso-paraffins (5) may be fractionated, such as by atmospheric distillation (6), to commercially useful fractions such as kerosene and diesel. A further useful fraction is an atmospheric bottoms fraction (8) of such distillation step (6), from which FT base oils may be produced typically by separating the atmospheric bottoms fraction (8) by a vacuum distillation step (9). Typically, such FT base oils have kinematic viscosity according to ASTM D445 at 100° C. in the range of from about 2 to about 15 $mm^2/s$.

As well as producing said FT base oils, the vacuum distillation step (9) produces a vacuum bottoms fraction (10), known in the art as "HVU bottoms".

The HVU bottoms fraction may be used as FT base oils without further processing, or other useful base oils can be produced from it by subjecting the HVU bottoms fraction to a further processing, such as catalytic de-waxing followed by a vacuum distillation step, to obtain a further bottoms fraction.

The base oils derived from such further bottoms fraction are referred to in the art as "extra heavy base oils", and typically have kinematic viscosity according to ASTM D445 at 100° C. in the range of from about 15 to about 35 $mm^2/s$.

As discussed earlier, at ambient temperature, and particularly at 0° C. and below, FT residual base oils and their fractions can suffer from the undesirable presence of a waxy haze, and it was observed by the inventors of the present method that none of conventional processes of de-hazing, whether solvent de-waxing or catalytic de-waxing, were capable of removing the waxy haze, and thereby reduce the cloud point to below 0° C. of FT residual base oils and their fractions (such as the HVU bottoms fraction (10) and the further bottoms fraction (14)).

The inventors of the present method surprisingly discovered that a naphtha fraction (7) may be obtained from the atmospheric distillation step (6) (such distillation step being conventionally used to fractionate the more heavily branched iso-paraffins (5) into the commercially useful fractions such as kerosene and diesel), and such naphtha fraction (7) may be used successfully in the solvent de-waxing of the above mentioned FT residual base oils and their fractions.

As used herein, references to "paraffinic(s)" refer to alkanes, and references to "saturates" refer to carbon compounds devoid of double and triple carbon-carbon bonds.

Suitably, the naphtha fraction (7) comprises paraffinic molecules with boiling points less than 200° C. at ambient atmospheric pressure. Preferably, the lower boiling point fraction comprises paraffinic molecules with boiling points between 35° C. and 200° C., more preferably boiling points between 40° C. and 200° C., and even more preferably boiling points between 70° C. and 170° C., all boiling points being at around ambient atmospheric pressure.

Preferably, the paraffinic naphtha fraction according to the present invention comprises less than 5 wt. % of aromatics and a content of paraffins of more than 90 wt. % according to ASTM D6839. More preferably, the paraffinic fraction comprises at least 90 wt. % paraffins, at most 5 wt. % aromatics and at most 1 wt. % olefins. Even more preferably, the paraffinic naphtha fraction comprises n-paraffins in a range of from 40 to 50 wt. %, iso-paraffins in a range of from 50 to 60 wt. %, naphthenes in a range of from 2 to 3 wt. % and aromatics in a range of from 0 to 0.1 wt. %.

Suitably, the naphtha fraction (7) comprises paraffinic molecules comprising carbon chain length of up to 11.

Preferably, the naphtha fraction (7) comprises paraffinic molecules comprising carbon chain length in the range of from 5 to 11, more preferably the naphtha fraction (7) comprises paraffinic molecules comprising carbon chain lengths of from 6 to 10, even more preferably the naphtha fraction (7) comprises paraffinic molecules comprising carbon chain lengths of from 6 to 9, and most preferably the naphtha fraction (7) comprises paraffinic molecules comprising carbon chain lengths of from 6 to 8. Optionally, naphtha fraction (7) may be a paraffinic molecule of carbon chain length of 7, such as heptane.

Further, suitably, the naphtha fraction (7) comprises paraffinic molecules of carbon chain length of 6, 7 and 8.

Suitably, the naphtha fraction (7) comprises paraffinic molecules of carbon chain length of either 5, or 6, or 7, or 8, or 9, or 10, or 11.

Suitably, the naphtha fraction (7) comprises a mixture of any combination thereof of paraffinic molecules of carbon chain length of either 5, or 6, or 7, or 8, or 9, or 10, or 11.

Examples of the naphtha fraction (7) a mixture of any combination thereof of paraffinic molecules of carbon chain length of either 5, or 6, or 7, or 8, or 9, or 10, or 11, may be for example, a paraffinic molecule of carbon chain length of 5 in a mixture comprising at least a paraffinic molecule of carbon chain length of 6, or 7, or 8, or 9, or 10, or 11; or an alkane of carbon chain length of 6 in a mixture comprising at least a paraffinic molecule of carbon chain length of 5, or 7, or 8, or 9, or 10, or 11; or an alkane of carbon chain length of 7 in a mixture comprising at least a paraffinic molecule of carbon chain length of 5, or 6, or 8, or 9, or 10, or 11; or an alkane of carbon chain length of 8 in a mixture comprising at least a paraffinic molecule of carbon chain length of 5, or 6, or 7, or 9, or 10, or 11; or an alkane of carbon chain length of 9 in a mixture comprising at least a paraffinic molecule of carbon chain length of 5, or 6, or 7, or 8, or 10, or 11; or an alkane of carbon chain length of 10 in a mixture comprising at least a paraffinic molecule of carbon chain length of 5, or 6, or 7, or 8, or 9, or 11; or an alkane of carbon chain length of 11 in a mixture comprising at least a paraffinic molecule of carbon chain length of 5, or 6, or 7, or 8, or 9, or 10.

In the method of the present invention, the cloud point of a Fischer-Tropsch derived fraction is reduced to below 0° C.

The Fischer-Tropsch derived fraction may be the HVU bottoms fraction (10), the further bottoms fraction (14), or any other fraction derived from the HVU bottoms fraction (10), as long as such fraction comprises Fischer-Tropsch process derived paraffins. Suitably, the Fischer-Tropsch derived fraction may be subjected to a catalytic de-waxing step prior to being subjected to the cloud point reduction step, and further, suitably a bottoms fraction may be obtained from such catalytic de-waxing step, and its product may be used as the Fischer-Tropsch derived fraction. Preferably, the Fischer-Tropsch derived fraction has a kinematic viscosity at 100° C. between 15 and 35 $mm^2/s$.

In one embodiment, the Fischer-Tropsch derived fraction may be the HVU bottoms fraction (10) obtained via the vacuum distillation (9) of the atmospheric bottoms fraction (8). In such an embodiment, the Fischer-Tropsch derived fraction comprises alkanes with boiling points above 540° C. Preferably, the vacuum distillation step (9) is performed at a pressure of about 0.004 MPa.

In another embodiment, the Fischer-Tropsch derived fraction may be the further bottoms fraction (14). The further bottoms fraction (14) may be obtained by subjecting the HVU bottoms fraction (10) to a further vacuum distillation step (13) to distill off the smaller molecules that may be present in the HVU bottoms fraction (10) from the further bottoms fraction (14). In such an embodiment, the Fischer-Tropsch derived fraction comprises paraffinic molecules with boiling points above 480° C. Preferably, the vacuum distillation step (9) is performed at a pressure of about 0.004 MPa.

The Fischer-Tropsch derived fraction may be subjected to a catalytic de-waxing step prior to being subjected to the cloud point reduction step. For example, the Fischer-Tropsch derived fraction may be obtained by subjecting the HVU bottoms fraction (10), as a first step, to a catalytic de-waxing step (11) in a manner known in the art, then subjecting the catalytically de-waxed fraction (12) to said further vacuum distillation step (13), again to distill off the smaller molecules that may be created during the said catalytic de-waxing step (11). In such an example, the Fischer-Tropsch derived fraction comprises paraffinic molecules with boiling points above 480° C. Preferably, the vacuum distillation step (9) is performed at a pressure of about 0.004 MPa.

In a further embodiment, the Fischer-Tropsch derived fraction may be a mixture comprising a mixture of the HVU bottoms fraction (10) and the further bottoms fraction (14).

The method of the present invention comprises the steps of subjecting the Fischer-Tropsch derived fraction to a cloud point reduction step comprising mixing the Fischer-Tropsch derived fraction with a solvent mixture, wherein the solvent mixture comprises a naphtha fraction and a co-solvent, and subjecting the solvent treatment mixture to a solvent de-waxing step.

Suitably, the co-solvent is methyl ethyl ketone. Suitably the co-solvent may also be methyl isobutyl ketone or methyl butyl ketone or methyl propyl ketone or methyl isopropyl ketone.

In the method of the present invention, suitably the weight ratio of the naphtha fraction to the co-solvent in the solvent mixture is in the range of from 70:30 wt. % to 30:70 wt. % respectively. Preferably, the weight ratio of the naphtha fraction to the co-solvent in the solvent mixture may be in the range of from 60:40 wt % to 40:60 wt. % respectively, and more preferably, the weight ratio of the naphtha fraction to the co-solvent in the solvent mixture may be 50:50 wt. % respectively.

In the method of the present invention, suitably the Fischer-Tropsch derived fraction is mixed with the solvent mixture in the weight ratio range of from 1:3 to 1:6 respectively at a temperature in the range of from 20° C. to 150° C. to provide a solvent treatment mixture.

Preferably, the weight ratio in which the Fischer-Tropsch derived fraction is mixed with the solvent mixture is 1:4 respectively.

Suitably, the temperature at which the Fischer-Tropsch derived fraction is mixed with the solvent mixture (16) may be in the range of from 30° C. to 150° C.

Suitably, the temperature at which the Fischer-Tropsch derived fraction is mixed with the solvent mixture (16) may be also in the range of from 40° C. to 120° C.

Following the mixing of the Fischer-Tropsch derived fraction with the solvent mixture (16), suitably the solvent treatment mixture (23) is cooled to below at least 0° C. to obtain a wax fraction (18) and a de-waxed fraction (19) comprising the Fischer-Tropsch derived fraction and the solvent mixture.

Preferably, the solvent treatment mixture (23) is cooled to below −20° C. to enable the formation, and removal, of wax fraction (18).

Suitably, the wax crystals (18) can be removed from the solvent treatment mixture (23) by subjecting the solvent treatment mixture (23) to a mechanical treatment (17) known in the art, such as by the use of a spinning drum to undertake a filtration process.

Once the wax crystals (18) are removed from the solvent treatment mixture (23), a de-waxed fraction (19) remains, comprising the Fischer-Tropsch derived fraction and the solvent mixture.

Suitably, the solvent mixture is removed from the de-waxed fraction as a used solvent mixture stream (21) by a distillation step (20) to obtain a Fischer-Tropsch derived base oil with a cloud point below 0° C.

DETAILED DESCRIPTION OF THE DRAWINGS

FIG. 1 shows a simplified schematic diagram of an embodiment of the method according to the invention.

A feedstream such as natural gas (1) is subjected to a Fischer-Tropsch condensation process (2) to produce carbon monoxide and hydrogen, which are then fed into a Fischer-Tropsch condensation process (3) to produce a hydrocarbon feed derived from a Fischer-Tropsch process with carbon chains in the order of from about 2 to about 200. Such feed is then subjected to a hydrocracking/hydroisomerisation step (4) to obtain an at least partially isomerised product (5). Examples of suitable hydrocracking/hydroisomerisation processes and suitable catalysts are described in WO200014179, EP0532118, EP666894 and EP776959.

The at least partially isomerised product (5) is subjected to an atmospheric distillation step (6) to obtain a naphtha fraction (7) and an atmospheric bottoms fraction (8).

A solvent mixture (16) is prepared by mixing the naphtha fraction (7) with a co-solvent (15).

In this depicted embodiment, the Fischer-Tropsch derived fraction is the further bottoms fraction (14), which is derived by subjecting the atmospheric bottoms fraction (8) to a vacuum distillation step (9) to obtain a HVU bottoms (10) fraction, which is then subjected to a catalytic de-waxing step (11) followed by a further vacuum distillation step (13) to obtain the further bottoms fraction (14).

In step (17), the further bottoms fraction (14), is mixed with the solvent mixture (16) to provide a solvent treatment mixture (23), and a solvent de-waxing process is carried out (17), which produces a wax fraction (18) and a de-waxed fraction (19). From the de-waxed fraction (19), the solvent mixture is removed as a used solvent mixture stream (21) by distillation (20) to produce the Fischer-Tropsch derived fraction with a cloud point of below 0° C. (22).

Figure 2:
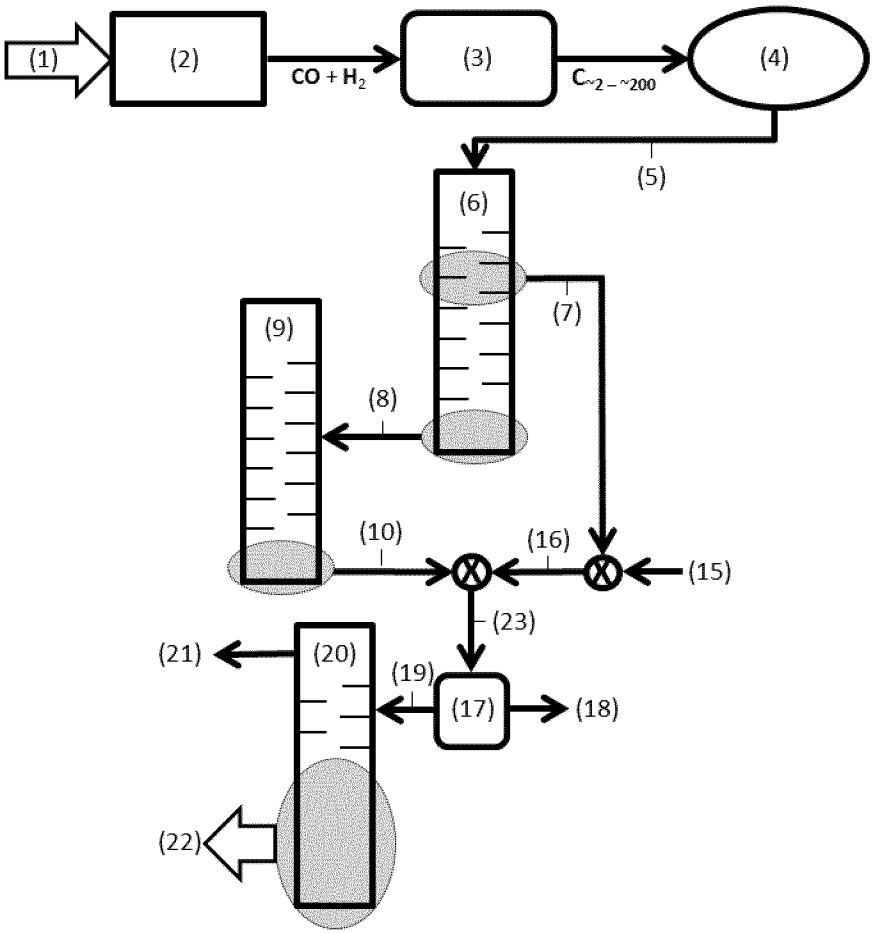
FIG. 2 shows a simplified schematic diagram of another embodiment of the method according to the invention, where the Fischer-Tropsch derived fraction is a HVU bottoms fraction.

FIG. 2 shows a simplified schematic diagram of another embodiment of the method according to the invention, where the Fischer-Tropsch derived fraction is the HVU bottoms fraction (10). In this depicted embodiment, the numbered steps and fraction are identified by the same numbers as in FIG. 1, except that this embodiment does not have the step (11) and (13), and fractions (12) and (14), as the HVU bottoms fraction (10) is mixed with the solvent mixture (16), to provide a solvent treatment mixture (23).

EXAMPLES

Example 1

HVU bottoms fraction (10), with a density at 150° C. of 760.8 kg/m$^3$, a kinematic viscosity according to ASTM D445 at 150° C. of 21.7 cSt, a pour point according to ASTM D97 of 102° C. and a cloud point according to ASTM D2500 of 104° C., was mixed with heptane and methyl ethyl ketone, 50/50 wt. % to form the solvent mixture (16), in a ratio of 4 parts by weight of solvent mixture (16) to 1 part by weight of the HVU bottoms fraction (10). The resultant solvent treatment mixture (23) was heated to dissolve its wax content, and subsequently was cooled to a temperature of −25° C. at a rate of 1° C. per minute. The cooled solvent treatment mixture (23) was filtered with a stack of Whatman filter papers (grades 41 and 42). The precipitated microcrystalline wax fraction (18) remained on the filter paper, while the de-waxed fraction (19) passed through the filter. The solvent mixture (16) component of the de-waxed fraction (19) was flashed from the de-waxed fraction (19) in a laboratory rotavap apparatus set to a temperature range of from about 135 to about 160° C. at reduced pressure.

The solvent de-waxed FT base oil (22) was found to be clear and bright at a temperature of 0° C. for a period of 7 hours; its kinematic viscosity at 100° C. was 21.2 cSt, its pour point was measured to be −6° C., and its cloud point was −2° C.

Example 2

HVU bottoms fraction (10), with a density at 150° C. of 760.8 kg/m$^3$, a kinematic viscosity according to ASTM D445 at 150° C. of 21.7 cSt, a pour point according to ASTM D97 of 102° C. and a cloud point according to ASTM D2500 of 104° C., was mixed with the naphtha fraction (7) and methyl ethyl ketone, 50/50 wt. % to form the solvent mixture (16), in a ratio of 4 parts by weight of solvent mixture (16) to 1 part by weight of the HVU bottoms fraction (10). The resultant solvent treatment mixture (23) was heated to dissolve its wax content, and subsequently cooled to a temperature of −25° C. at a rate of 1° C. per minute. The cooled solvent treatment mixture (23) was filtered with a stack of Whatman filter papers (grades 41 and 42). The precipitated microcrystalline wax fraction (18) remained on the filter while the de-waxed fraction (19) passed through the filter. The solvent mixture (16) component of the de-waxed fraction (19) was flashed from the HVU bottoms fraction in a laboratory rotavap apparatus set to a temperature range of from about 135 to about 160° C. at reduced pressure.

The solvent de-waxed FT base oil (22) was found to be clear and bright at a temperature of 0° C. for a period of 7 hours; its kinematic viscosity at 100° C. was measured to be 21.1 cSt, its pour point was measured to be −6° C., and its cloud point was −1° C.

Example 3

HVU bottoms fraction (10), with a kinematic viscosity according to ASTM D445 at 100° C. of 26.0 cSt, a pour point according to ASTM D97 of −12° C. and a cloud point according to ASTM D2500 of 90° C., was mixed with heptane and methyl ethyl ketone, 50/50 wt. % to form the solvent mixture (16), in a ratio of 3 parts by weight of solvent mixture (16) to 1 part by weight of the HVU bottoms fraction (10). The resultant solvent treatment mixture (23) was heated to dissolve its wax content and subsequently cooled to a temperature of −25° C. at a rate of 1° C. per minute. The cooled solvent treatment mixture (23) was filtered with a stack of Whatman filter papers (grades 41 and 42). The precipitated microcrystalline wax fraction (18) remained on the filter while the de-waxed fraction (19) passed through the filter. The solvent mixture (16) component of the de-waxed fraction (19) was flashed from the HVU bottoms fraction in a laboratory rotavap apparatus set to a temperature range of from about 135 to about 160° C. at reduced pressure.

The solvent de-waxed FT base oil (22) was found to be clear and bright at a temperature of 0° C. for a period of 7 hours, its kinematic viscosity at 100° C. was measured to be 21.9 cSt, its pour point was measured to be −15° C., and its cloud point was −7° C.

Example 4

The further bottoms fraction (14), with a density 70/4 of 0.805, a kinematic viscosity according to ASTM D445 at 100° C. of 21.2 cSt, a pour point according to ASTM D97 of −24° C. and a cloud point according to ASTM D2500 of 41° C., was mixed with heptane and methyl ethyl ketone, 50/50 50 wt. % to form the solvent mixture (16), in a ratio of 3 parts by weight of solvent mixture (16) to 1 part by weight of the further bottoms fraction (14). The resultant solvent treatment mixture (23) was heated to dissolve its wax content and subsequently cooled to a temperature of −25° C. at a rate of 1° C. per minute. The cooled solvent treatment mixture (23) was filtered with a stack of Whatman filter papers (grades 41 and 42). The precipitated microcrystalline wax fraction (18) remained on the filter while the de-waxed fraction (19) passed through the filter. The solvent mixture (16) component of the de-waxed fraction (19) was flashed from the HVU bottoms fraction in a laboratory rotavap apparatus set to a temperature range of from about 135 to about 160° C. at reduced pressure.

The solvent de-waxed FT base oil (22) was found to be clear and bright at a temperature of 0° C. for a period of 7 hours, its kinematic viscosity at 100° C. was measured to be 19.8 cSt, its pour point was measured to be −30° C., and its cloud point was −16° C.

Example 5

The further bottoms fraction (14), with a density 70/4 of 0.805, a kinematic viscosity according to ASTM D445 at 100° C. of 21.2 cSt, a pour point according to ASTM D97 of −24° C. and a cloud point according to ASTM D2500 of 41° C., was mixed with heptane/methyl ethyl ketone, 50/50 50 wt. % to form the solvent mixture (16), in a ratio of 3 parts by weight of solvent mixture (16) to 1 part by weight of the further bottoms fraction (14). The resultant solvent treatment mixture (23) was heated to dissolve its wax content and subsequently cooled to a temperature of −25° C. at a rate of 1° C. per minute. The cooled solvent treatment mixture (23) was filtered with a stack of Whatman filter papers (grades 41 and 42). The precipitated microcrystalline wax fraction (18) remained on the filter while the de-waxed fraction (19) passed through the filter. The solvent mixture (16) component of the de-waxed fraction (19) was flashed from the HVU bottoms fraction in a laboratory rotavap apparatus set to a temperature range of from about 135 to about 160° C. at reduced pressure.

The solvent de-waxed FT base oil (22) was found to be clear and bright at a temperature of 0° C. for a period of 7 hours; its kinematic viscosity at 100° C. was measured to be 19.8 cSt, the pour point was measured to be −30° C., and its cloud point was −9° C.

Example 6

The further bottoms fraction (14), with a density 70/4 of 0.805, a kinematic viscosity according to ASTM D445 at 100° C. of 21.2 cSt, a pour point according to ASTM D97 of −24° C. and a cloud point according to ASTM D2500 of 41° C., was mixed with the naphtha fraction (7) and methyl ethyl ketone, 50/50 wt. % to form the solvent mixture (16), in a ratio of 3 parts by weight of solvent mixture (16) to 1 part by weight of the further bottoms fraction (14). The resultant solvent treatment mixture (23) was heated to dissolve its wax content and subsequently cooled to a temperature of −25° C. at a rate of 1° C. per minute. The cooled solvent treatment mixture (23) was filtered with a stack of Whatman filter papers (grades 41 and 42). The precipitated microcrystalline wax fraction (18) remained on the filter while the de-waxed fraction (19) passed through the filter. The solvent mixture (16) component of the de-waxed fraction (19) was flashed from the HVU bottoms fraction in a laboratory rotavap apparatus set to a temperature range of from about 135 to about 160° C. at reduced pressure.

The solvent de-waxed FT base oil (22) was found to be clear and bright at a temperature of 0° C. for a period of 7 hours; its kinematic viscosity at 100° C. was measured to be 19.7 cSt, its pour point was measured to be −33° C., and its cloud point was −9° C.

Example 7

The further bottoms fraction (14), with a density 70/4 of 0.805, a kinematic viscosity according to ASTM D445 at 100° C. of 21.3 cSt, a pour point according to ASTM D97 of PP=−39° C. and a cloud point according to ASTM D2500 of CP=39° C., was mixed with petroleum spirit 40-65/ methyl ethyl ketone, 50/50 wt. % to form the solvent mixture (16), in a ratio of 3 parts by weight of solvent mixture (16) to 1 part by weight of the further bottoms fraction (14). The resultant solvent treatment mixture (23) was heated to dissolve its wax content and subsequently cooled to a temperature of −25° C. at a rate of 1° C. per minute. The cooled solvent treatment mixture (23) was filtered with a stack of Whatman filter papers (grades 41 and 42). The precipitated microcrystalline wax fraction (18) remained on the filter while the de-waxed fraction (19) passed through the filter. The solvent mixture (16) component of the de-waxed fraction (19) was flashed from the HVU bottoms fraction in a laboratory rotavap apparatus set to a temperature range of from about 135 to about 160° C. at reduced pressure.

The solvent de-waxed FT base oil (22) was found to be clear and bright at a temperature of 0° C. for a period of 7 hours; its kinematic viscosity at 100° C. was measured to be 19.8 cSt, its pour point was measured to be −36° C., and its cloud point was −12° C.

Example 8

The further bottoms fraction (14), with a density 70/4 of 0.805, a kinematic viscosity according to ASTM D445 at 100° C. of 21.3 cSt, a pour point according to ASTM D97 of −39° C. and a cloud point according to ASTM D2500 of 39° C., was mixed with pentane/methyl ethyl ketone, 50/50 wt. % to form the solvent mixture (16), in a ratio of 3 parts by weight of solvent mixture (16) to 1 part by weight of the further bottoms fraction (14). The resultant solvent treatment mixture (23) was heated to dissolve its wax content and subsequently cooled to a temperature of −25° C. at a rate of 1° C. per minute. The cooled solvent treatment mixture (23) was filtered with a stack of Whatman filter papers (grades 41 and 42). The precipitated microcrystalline wax fraction (18) remained on the filter while the de-waxed fraction (19) passed through the filter. The solvent mixture (16) component of the de-waxed fraction (19) was flashed from the HVU bottoms fraction in a laboratory rotavap apparatus set to a temperature range of from about 135 to about 160° C. at reduced pressure.

The solvent de-waxed FT base oil (22) was found to be clear and bright at a temperature of 0° C. for a period of 7 hours; its kinematic viscosity at 100° C. was measured to be 19.8 cSt, its pour point was measured to be −36° C., and its cloud point was −10° C.

Example 9

A mixture of 18% w HVU bottoms fraction (10), properties as described in example 1, and 82% w further bottoms fraction (14), properties as described in example 7, was mixed with heptane/methyl ethyl ketone, 50/50 wt. % to form the solvent mixture (16), in a ratio of 4 parts by weight of solvent mixture (16) to 1 part by weight of the HVU bottoms (10)/further bottoms fraction (14) mixture. The resultant solvent treatment mixture (23) (i.e. diluted HVU bottoms fraction (10)/further bottoms fraction (14) mixture) was heated to dissolve its wax content and subsequently cooled to a temperature of −25° C. at a rate of 1° C. per minute. The cooled solvent treatment mixture (23) was filtered with a stack of Whatman filter papers (grades 41 and 42). The precipitated microcrystalline wax fraction (18) remained on the filter while the de-waxed fraction (19) passed through the filter. The solvent mixture (16) component of the de-waxed fraction (19) was flashed from the HVU bottoms fraction in a laboratory rotavap apparatus set to a temperature range of from about 135 to about 160° C. at reduced pressure.

The solvent de-waxed FT base oil (22) was found to be clear and bright at a temperature of 0° C. for a period of 7 hours; its kinematic viscosity at 100° C. was measured to be 19.8 cSt, its pour point was measured to be −30° C., and its cloud point was −7° C.

COMPARATIVE EXAMPLES

Example 10

The further bottoms fraction (14), with a density 70/4 of 0.805, a kinematic viscosity according to ASTM D445 at 100° C. of 21.3 cSt, a pour point according to ASTM D97 of −39° C. and a cloud point according to ASTM D2500 of 39° C., was mixed with the diluent petroleum spirit 40-65, in a ratio of 2 parts by weight of diluents to 1 part by weight of further bottoms fraction (14). The solvent treatment mixture (23) was heated to dissolve the wax and subsequently cooled to a temperature of −20° C. at a rate of 1° C. per minute. The cooled solvent treatment mixture (23) was filtered with a stack of Whatman filter papers (grades 41 and 42). The diluent was flashed from solvent treatment mixture (23) in a laboratory rotavap apparatus in a temperature range of 135−160° C. at reduced pressure.

The obtained FT residual base oil fraction (22) was found to be hazy at a temperature of 0°. The kinematic viscosity at 100° C. was 21.0 cSt, the pour point was measured at −30° C., and the cloud point at 26° C.

Example 11

The further bottoms fraction (14), with a density 70/4 of 0.805, a kinematic viscosity according to ASTM D445 at 100° C. of 21.3 cSt, a pour point according to ASTM D97 of −39° C. and a cloud point according to ASTM D2500 of 39° C., was mixed with the diluent heptane, in a ratio of 4 parts by weight of diluents to 1 part by weight of the further bottoms fraction (14). The diluted extra heavy base oil fraction was heated to dissolve the wax and subsequently cooled to a temperature of −25° C. at a rate of 1° C. per minute. The cooled solvent treatment mixture (23) was filtered with a stack of Whatman filter papers (grades 41 and 42). The diluent was flashed from the solvent treatment mixture (23) in a laboratory rotavap apparatus in a temperature range of 135−160° C. at reduced pressure.

The obtained FT residual base oil fraction (22) was found to be hazy at a temperature of 0°. The kinematic viscosity at 100° C. was 20.6 cSt, the pour point was measured at −30° C., and the cloud point at 19° C.

Example 12

The further bottoms fraction (14), with a density 70/4 of 0.805, a kinematic viscosity according to ASTM D445 at 100° C. of 21.2 cSt, a pour point according to ASTM D97 of −24° C. and a cloud point according to ASTM D2500 of 41° C., was mixed with toluene/methyl ethyl ketone, 50/50 weight percentage, in a ratio of 4 parts by weight of diluents to 1 part by weight of the further bottoms fraction (14). The diluted solvent treatment mixture (23) was heated to dissolve the wax and subsequently cooled to a temperature of −20° C. at a rate of 1° C. per minute. The cooled solvent treatment mixture (23) was filtered with a stack of Whatman filter papers (grades 41 and 42).

Filtration proved cumbersome; a gel-type filter cake was formed that plugged the filter. After a prolonged filtration time (exceeding 8 hours) a hazy diluted FT residual oil fraction was collected. No further work-up was done.

Example 13

The further bottoms fraction (14), with a density 70/4 of 0.805, a kinematic viscosity according to ASTM D445 at 100° C. of 21.3 cSt, a pour point according to ASTM D97 of −39° C. and a cloud point according to ASTM D2500 of 39° C., was mixed with straight run naphtha/methyl ethyl ketone, 50/50 weight percentage, in a ratio of 4 parts by weight of diluents to 1 part by weight of the further bottoms fraction (14). Straight run naphtha was obtained from Beryl crude (North Sea) and comprised 58.9% paraffins, 26.8% naphthenes (together 85.7% saturates) and 14.3% aromatics (weight percentages). The diluted solvent treatment mixture (23) was heated to dissolve the wax and subsequently cooled to a temperature of −25° C. at a rate of 1° C. per minute. The cooled solvent treatment mixture (23) was filtered with a stack of Whatman filter papers (grades 41 and 42).

Filtration proved cumbersome; a gel-type filter cake was formed that plugged the filter. After a prolonged filtration time (exceeding 4 hours) only a limited amount of diluted FT residual oil fraction was collected. Because of the low yield no further work-up was done.

That which is claimed is:

1. A method for reducing the cloud point of a Fischer-Tropsch derived fraction to below 0° C., wherein the method comprises:

(a) combining the Fischer-Tropsch derived fraction with a solvent and a co-solvent (15) to form a treatment mixture, wherein the Fischer-Tropsch derived fraction comprises more than 80% of paraffins and 90% of saturates, with a solvent mixture (16), wherein the solvent comprises a paraffinic naphtha fraction (7), and wherein the co-solvent comprises one or more of methyl isobutyl ketone, methyl butyl ketone, methyl propyl ketone, and methyl isopropyl ketone;

(b) cooling the treatment mixture to a temperature of less than −20° C. to form a wax crystal and a de-waxed mixture comprising a portion of the solvent and a de-waxed oil;

(c) separating the wax crystal from the de-waxed mixture to form a separated de-waxed mixture comprising the portion of the solvent and the de-waxed oil;

(d) distilling the separated de-waxed mixture to form a distilled solvent and a de-waxed oil, wherein the de-waxed oil comprises a cloud point below 0° C.

2. The method according to claim 1, wherein the paraffinic naphtha fraction (7) comprises paraffinic molecules comprising carbon chain length in the range of from 5 to 11.

3. The method according to claim 1, wherein the paraffinic naphtha fraction (7) comprises paraffinic molecules of at least one of carbon chain length 6, 7 and 8.

4. The method according to claim 1, wherein the paraffinic naphtha fraction (7) comprises paraffinic molecules of carbon chain length comprising one or more of 5, 6, 7, 8, 9, 10, and 11.

5. The method according to claim 1, wherein the co-solvent further comprises methyl ethyl ketone.

6. The method according to claim 1, wherein the weight ratio of the naphtha fraction to the co-solvent (15) is from 70:30 to 30:70.

7. The method according to claim 1, wherein the combining the Fischer-Tropsch derived fraction with the solvent is done at a ratio of the Fischer-Tropsch derived fraction to solvent of from 1:3 to 1:6, and wherein the combining the Fischer-Tropsch derived fraction with the solvent is done at a temperature from 20° C. to 150° C.

8. The method according to claim 1, further comprising subjecting the Fischer-Tropsch derived fraction prior to the combining the Fischer-Tropsch derived fraction with the solvent.

* * * * *